US006452336B1

(12) United States Patent
Dandu

(10) Patent No.: US 6,452,336 B1
(45) Date of Patent: Sep. 17, 2002

(54) FLOURESCENT LAMP FOR RECESSED CEILING MOUNTING

(76) Inventor: Raju S. Dandu, 1332 S. Minneapolis, Salina, KS (US) 67401

( * ) Notice: Subject to any disclaimer, the term of this patent is extended or adjusted under 35 U.S.C. 154(b) by 0 days.

(21) Appl. No.: 09/843,450

(22) Filed: Apr. 26, 2001

(51) Int. Cl.[7] ..... H01J 13/46
(52) U.S. Cl. ..... 315/56; 362/364
(58) Field of Search ..... 315/56, 58, 57; 362/364, 365, 366, 362, 147, 148

(56) References Cited

U.S. PATENT DOCUMENTS 5,562,343 A * 10/1996 Chan et al. ..... 362/365
5,836,677 A * 11/1998 Connors et al. ..... 362/304
6,095,671 A * 8/2000 Hutain ..... 362/373
6,350,046 B1 * 2/2002 Lau ..... 362/364

* cited by examiner

*Primary Examiner*—Don Wong
*Assistant Examiner*—Tuyet T. Vo
(74) *Attorney, Agent, or Firm*—Kenneth Jack

(57) ABSTRACT

A lamp for recessed ceiling mounting consisting of a ceiling aperture lining flange defining an air dam receiving space; a mounting plate fixedly attached to and extending outwardly from the upper end of said flange; a ballast; spirally threaded screws removedly mounting the ballast upon the mounting plates; a concave air dam having an interior flourescent tube receiving space; a plurality of friction clips connecting the air dam to said flange, said clips positioning the air dam within said flange's air dam receiving space; a flourescent light tube; and a plurality of spring clips mounting the flourescent light tube within the interior space of the concave air dam.

20 Claims, 4 Drawing Sheets

FLOURESCENT LAMP FOR RECESSED CEILING MOUNTING

FIELD OF THE INVENTION

This invention relates to flourescent lamps. More particularly, this invention relates to flourescent lamps adapted for upwardly recessed mounting within the ceilings of buildings.

BACKGROUND OF THE INVENTION

Interior ceilings of commercial or residential buildings commonly comprise a sheet material skin consisting of gypsum board (i.e., "sheetrock") or acoustic tiles. Where a ceiling comprises gypsum board, panels thereof are typically nailed or screwed to the undersurfaces of ceiling trusses or ceiling joists, causing the panels to span therebetween. Such panels form a thermal barrier or convective heat flow barrier between the living space below the joists or trusses and "dead" spaces between and overlying the joists or trusses.

Where a ceiling comprises acoustic ceiling tiles, such tiles are typically suspended beneath such ceiling joists or trusses by a grid of tile supporting runners and tee bars; such grid being suspended beneath such trusses or joists by wires. As with gypsum board, acoustic tiles form a convective heat flow or thermal barrier between living space below and dead space above. The thermal barrier functions of gypsum boards and acoustic tiles normally enhance the energy efficiency of buildings. Where ceiling lamp fixtures are recessed upwardly within a gypsum board ceiling panel or within an acoustic ceiling tile, the panel or tile is necessarily perforated, compromising the panel's or tile's thermal barrier function.

Where a common tungsten filament incandescent lamp is recessed upwardly within such gypsum board or acoustic tile ceiling, heat generated by such lamp commonly necessitates provision of air vents within the light fixture, allowing upward air convection from the living space below, across the bulb, through the vent, and thence into the dead space above. Such upward air convection beneficially cools the incandescent lamp and the recessed fixture. However, such vents undesirably degrade or limit the thermal barrier function of gypsum board or acoustic ceiling tile within which such fixture may be installed.

A flourescent light tube which emits visible light equivalent to that of a 100 watt incandescent bulb will typically emit less infrared light or radiant heat than that of a 25 watt incandescent bulb. Thus, where flourescent light tubes are recessed upwardly within such gypsum board or acoustic tile ceilings, there typically is little need for providing air convection apertures. However, unlike common incandescent lamps, flourescent lamps typically comprise a phosphor lined argon and mercury vapor filled tube and an iron or electronic ballast, both of which are subject to periodic failure. Thus, where a flourescent light tube is upwardly recessed within such gypsum board or acoustic tile ceiling, the fixture desirably facilitates convenient removal and replacement of both the ballast and the light tube, in addition to preserving the thermal barrier characteristics of the gypsum board or acoustic tile.

Common recessed flourescent light fixtures undesirably compromise the thermal barrier function of the fixture in favor of enhancing interchangeability of the ballast and/or the flourescent tube. The instant inventive recessed flourescent light fixture ameliorates said common undesirable trait of recessed flourescent light fixtures by providing structures which adapt the fixture to simultaneously facilitate interchangeability of the ballast, facilitate interchangeability of the flourescent light tube, and preserve a ceiling's thermal barrier function.

BRIEF SUMMARY OF THE INVENTION

The instant inventive lamp is preferably recessable upwardly into a gypsum board or acoustic tile ceiling. Suitably, the lamp may be recessed within other types of sheet ceiling materials. A primary structural component of the inventive lamp comprises a cylindrical ceiling aperture lining flange, said flange defining an air dam receiving space. Preferably, the height of such flange is equivalent to the thickness of the gypsum board or acoustic tile within which the inventive light fixture is to be upwardly recessed. The horizontal cross-sectional shape of such flange preferably compliments the shape of the flourescent light tube which the fixture is intended to support and illuminate. For example, where the intended flourescent light tube is circline (a preferred configuration), such horizontal cross sectional shape is preferably circular. For further example, where the flourescent light tube is linear and horizontally mounted, such cross-sectional shape is preferably rectangular. In practice, the flange is preferably, fixedly, and rigidly attached to the ceiling so that it nests within and closely lines an aperture cut through the gypsum board or acoustic tile.

While the cylindrical ceiling aperture lining flange may suitably be attached directly to the apertured gypsum board or acoustic tile, such flange is preferably mounted upon ceiling trusses or ceiling joists which overlie and suspend the gypsum board or acoustic tile. Alternately, the flange may be mounted upon runners of a drop ceiling grid. Necessarily, the ceiling attachment of such flange rigidly positions such flange within the aperture within the gypsum board or acoustic tile.

Numerous ceiling mounting means may be suitably utilized for attaching the cylindrical ceiling aperture lining flange to the ceiling's trusses or joists. For example, bars or braces spanning between an upper edge of said flange and said joists, trusses, or runners may be provided. As a further example, steel or aluminum wires may be utilized to interconnect said flange and trusses, joists or runners. However, preferably, the means for attaching said flange to such joists, trusses, or runners comprises a support frame including a rectangular steel mounting plate having an aperture there through, the aperture closely matching the dimensions of the cylindrical ceiling aperture lining flange. Suitably, the upper end of such flange may be spot-welded to such plate so that such flange extends downwardly from the edges of such aperture. Alternately, the flange may be formed from the edges of the mounting plate's aperture through metal bending.

Suitably, the dimensions of such rectangular plate may be approximately 14½ inches by 21½ inches, such dimensions allowing such plate to span between typical 24 inch "on center" mounted ceiling trusses, or between 16 inch "on center" mounted ceiling/floor joists. Where ceiling trusses or joists are mounted in such standard fashion and where the peripheral edges of such rectangular plate are upwardly flanged, such plate may be conveniently installed between such trusses or joists by nailing through such flanges directly into the side walls of such trusses or joists. However, such plate preferably has smaller dimensions, allowing for convenient installation between variously positioned ceiling trusses, joists, or other structures such as drop ceiling runners. To facilitate universal installability, the preferred ceiling mounting means comprises such smaller rectangular steel plate having its peripheral edges formed to include brace clips; such clips being adapted for engaging telescoping "T" braces, whose distal ends are preferably adapted for nailing directly onto the side walls of ceiling trusses or joists, or adapted for mounting upon other structures such as drop ceiling runners.

Necessarily, the instant inventive light fixture comprises a flourescent light tube actuating ballast. Preferably, such ballast is an electronic ballast. Suitably, such ballast may be an iron ballast. Means for removably mounting the ballast upon the upper end of the cylindrical ceiling aperture lining flange are necessarily provided. Suitably, said means may comprise a bracket extending upwardly and outwardly from the upper end of said flange, the ballast being attached to a distal end of said bracket by means such as spirally threaded screws, spirally threaded bolts, slip joint attachments, or other common removable fasteners. Preferably, the removable ballast mounting means comprises the preferred rectangular mounting plate, the ballast being attached to the plate by spirally threaded screws, or other common removable fasteners. Preferably, the ballast is positioned upon the plate so that alternate installation and removal can be effectuated manually from below through the air dam receiving space of the cylindrical ceiling aperture lining flange.

The inventive light fixture's function as a thermal barrier is primarily accomplished by provision of a concave air dam having an inner surface defining a flourescent light tube receiving space. Preferably, the concave air dam is fitted for upward extension through the air dam receiving space of the cylindrical ceiling aperture lining flange, and preferably the lower lip of said air dam forms and out-turned trim retaining/slide stopping flange. Preferably, the inner surface of the air dam is reflective, enhancing the lamp's illuminating capability. Also preferably, a side wall of the concave air dam has a wire receiving aperture through which the ballast's output wires extend. Where such wire receiving aperture is provided, a rubber annular air seal spanning the annulus between said wires and the edges of said aperture is also preferably provided.

Means for removably and interchangeably mounting the concave air dam within the air dam receiving space of the cylindrical ceiling aperture lining flange are necessarily provided. Suitably, said means may comprise a bracket or brace spanning between an exterior side wall of the air dam, and a ceiling mounting means structure such as the preferred rectangular plate. However, the air dam mounting means preferably directly interconnects the concave air dam and the cylindrical ceiling aperture lining flange. Suitably, spirally threaded screws may be utilized to accomplish such interconnection. Preferably, such interconnection is accomplished by a friction mount such as friction clips which allow alternate manual installation of the air dam into and extraction of the air dam from the cylindrical lining flange through application of alternate pulling and pushing forces.

Finally, means for removably mounting the flourescent light tube upon the inner surface of the concave air dam are provided. Suitably, said means may comprise a simple shelf bracket upon which the tube rests. Ties or straps spanning between the tube and the inner wall of the air dam may also be suitably used. However, preferably, said removable mounting means comprises a plurality of arcuately formed spring clips adapted for engaging and holding the curved walls of the flourescent light tube. Proximal ends of such clips are preferably riveted to the inner wall of the air dam.

In some installation environments the ballast and air dam of the instant inventive flourescent light fixture is undesirably exposed within the dead space which overlies the gypsum board or acoustic ceiling tile. Where such dead space serves as an attic, an exposed ballast or air dam may become damaged by persons walking within the attic. Also, blown or rolled insulation within the dead space may undesirably interfere with the functions of the ballast and air dam. Where such concerns exist, a shroud is preferably provided to protect the ballast and the air dam from damage or encroachment of insulating material. While the shroud may suitably be configured as an open frame or grid, the shroud preferably comprises a box, which in combination with the preferred steel plate mounting means, forms an substantially occlusive closure. Where such a shroud is provided, the ballast mounting means preferably comprises one of the shroud's side walls, the ballast preferably being attached to one of said wall's inner surfaces by means of spirally threaded screws. Also, where such shroud is provided, the ballast's input power wires preferably extend through an aperture within said side wall, and thence into an electric junction box fixedly attached to the exterior surface of said side wall, the junction box providing for secure attachment of a protective electric conduit.

Accordingly, it is an object of the present invention to provide a recessed flourescent light fixture which facilitates convenient ballast removal and replacement, convenient flourescent light tube removal and replacement, and which preserves thermal barrier characteristics of gypsum board, acoustic tile, or other sheet ceiling material within which such light fixture is recessed.

Other and further objects, benefits, and advantages of the present invention will become known to those skilled in the art upon review of the Detailed Description which follows, and upon review of the appended drawings.

DETAILED DESCRIPTION OF THE PREFERRED EMBODIMENT

Figure 1:
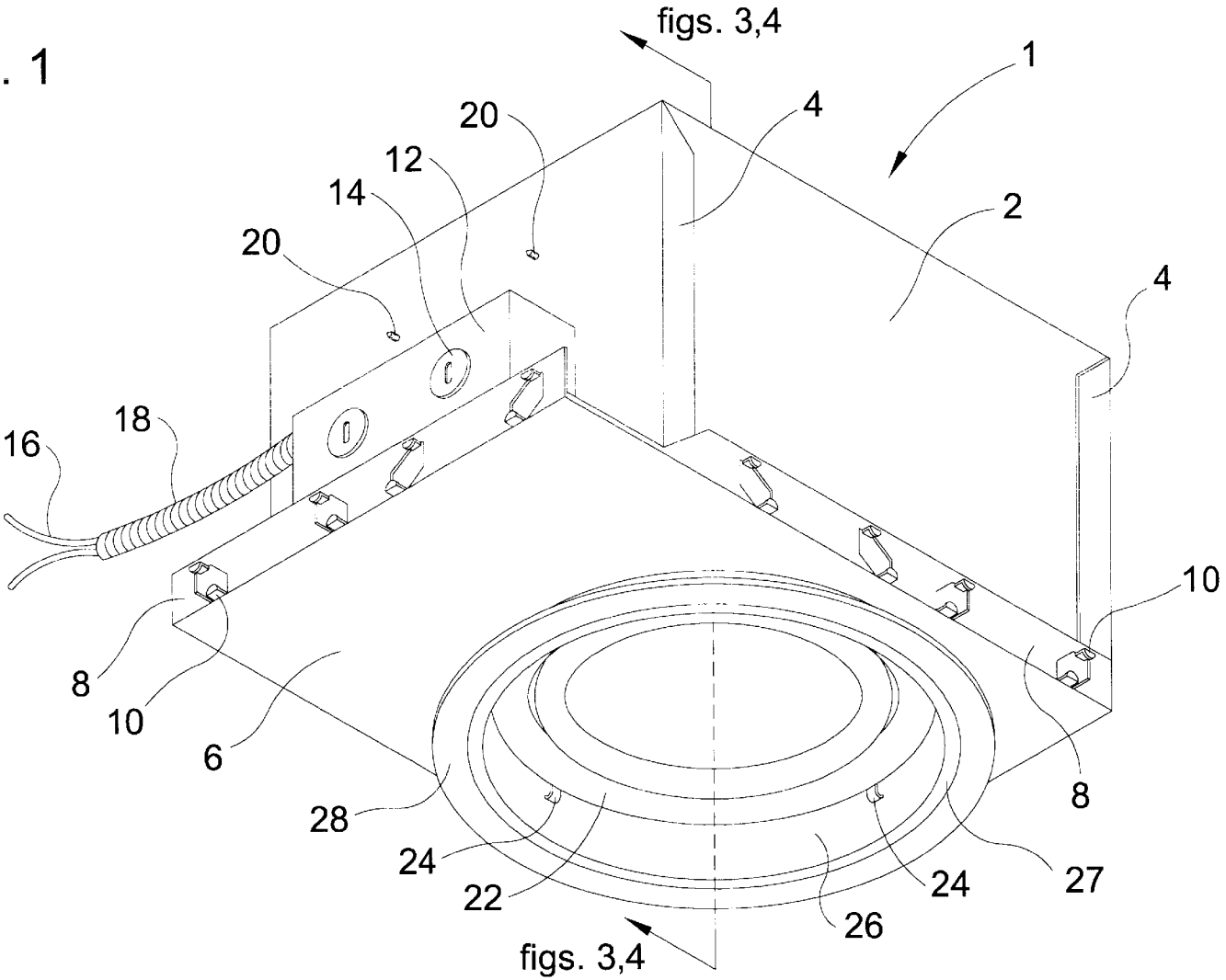
FIG. 1 is an isometric view of a preferred embodiment of the instant inventive recessed flourescent lamp.
Figure 4:
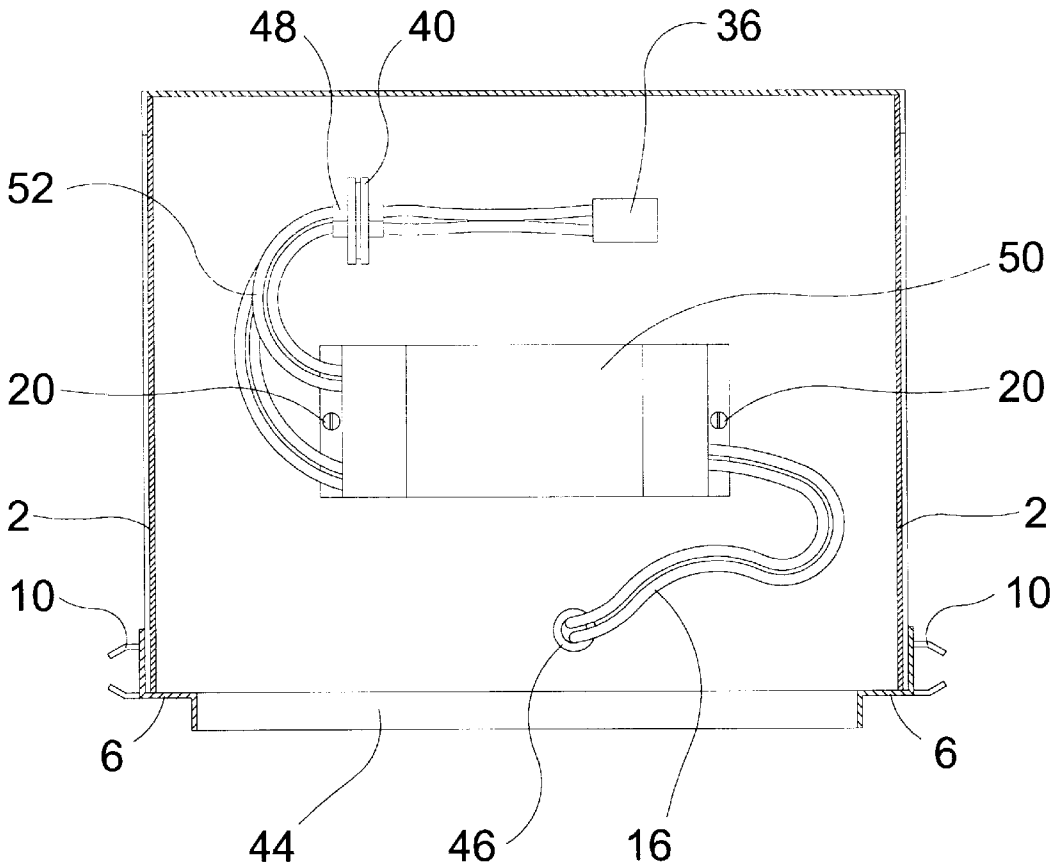
FIG. 4 is an alternate sectional view as indicated in FIG. 1, the view showing concave air dam and circline flourescent light tube removed, exposing to view a ballast.

Referring now to the drawings, and in particular to FIG. 1, the instant inventive flourescent lamp is referred to generally by Reference Arrow 1. Referring simultaneously to FIGS. 1 and 4, a cylindrical ceiling aperture lining flange 44 extends downwardly from a rectangular mounting frame or plate 6, said flange 44 defining an air dam receiving space. Referring again to FIG. 1, mounting plate 6 preferably has peripheral upturned flanges 8, said flanges preferably being configured to form a plurality of "T" brace clips 10. The mounting plate 6 in combination with clips 10 provide a ceiling mounting means allowing flange 44 to be fixedly suspended between ceiling trusses or ceiling joists (not depicted) or between drop ceiling runners (not depicted) for downward extension of said flange 44 through an aperture within a ceiling gypsum board panel (not depicted) or a ceiling acoustic tile (not depicted).

Referring simultaneously to FIGS. 1 and 4, a flourescent light tube actuating ballast 50 is removably attached by means of sheet metal screws 20 to a flanged side wall 4 of a box shroud 2. Preferably, ballast 50 comprises an electronic ballast. Suitably, ballast 50 may comprise an iron ballast. Preferably, wall 4 of shroud 2 has a rubber seal lined aperture 46 through which a network of electrically conductive wires extend, such network preferably comprising input power cord 16 and output power cords 52. Preferably, the input power cords 16 are sheathed by a flexible aluminum conduit 18. Also preferably, an electric junction box 12 having a plurality of knock out plugs 14 is fixedly attached to the exterior surface of wall 4, such junction box 12 providing a means for secure attachment of conduit 18. Preferably, the terminal output end of the network of electrically conductive wires, 16 and 52, comprises a female four prong electrical connector 36.

Figure 3:
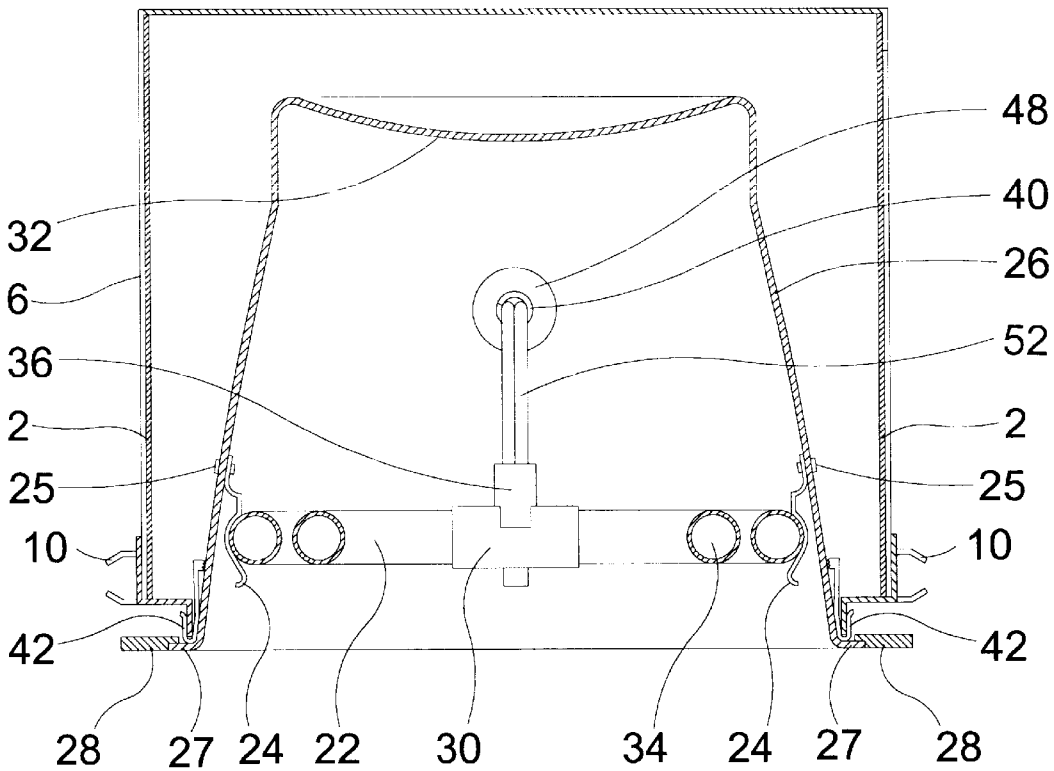
FIG. 3 is a sectional view as indicated in FIG. 1.

Referring simultaneously to FIGS. 1, 3, and 4, a concave air dam 26, preferably having a reflective inner surface, is installed within the air dam receiving space of flange 44 by means of friction clips 42. Preferably, the lower lip of air dam forms an out-turned trim retaining/slide stopping flange 27; and preferably the upper end or ceiling of air dam 26 forms a convex dome 32 for enhancement of the air dam's light reflecting characteristics.

Figure 2:
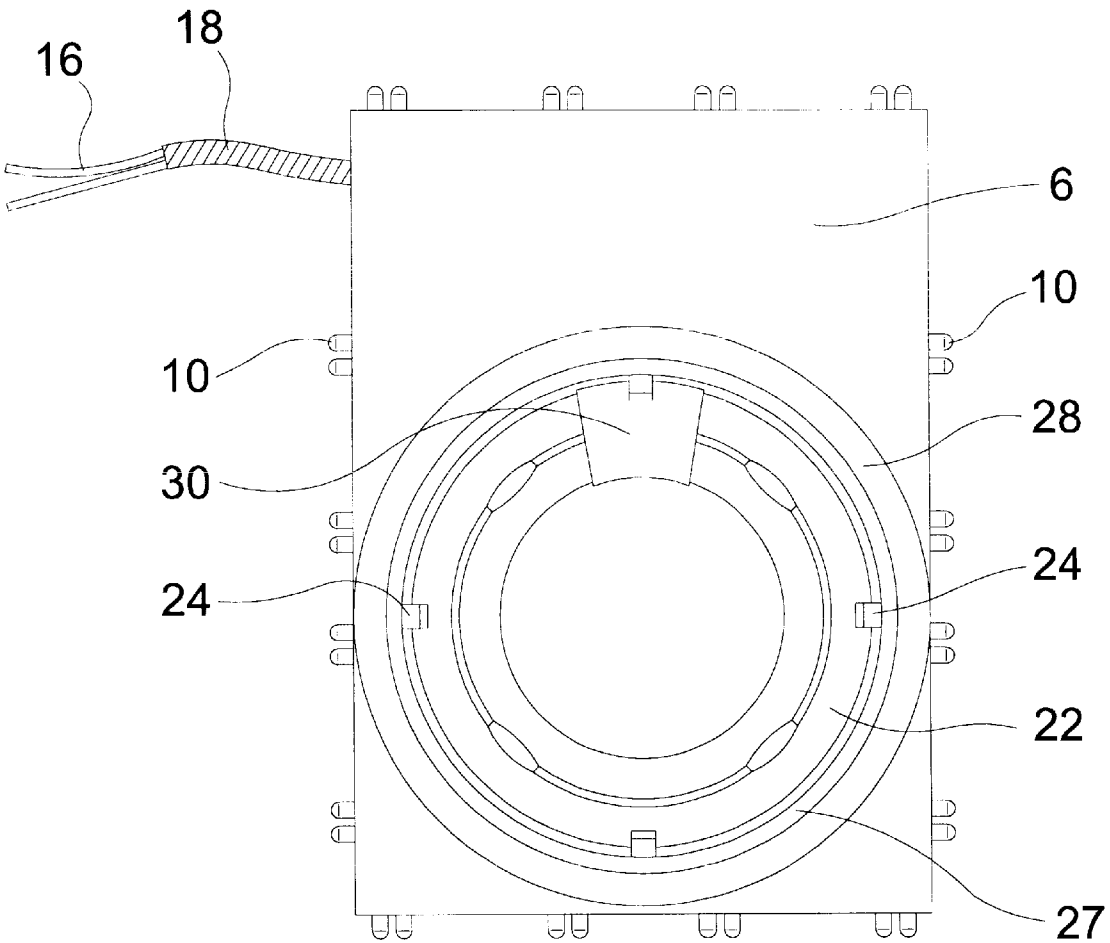
FIG. 2 is a view of the undersurface of the lamp depicted in FIG. 1.

Referring simultaneously to FIGS. 2 and 3, a preferred circline flourescent light tube 22 is provided, such tube having a phosphor lined argon gas and mercury vapor filled interior space 34. Tube 22 is preferably removably mounted within the interior tube receiving space of the air dam 26 by means of spring clips 24, the proximal ends of which are preferably fixedly mounted by means of rivets 25. Preferably, the circline flourescent tube 22 has an electric terminal housing 30, such housing supporting a male four prong connector adapted for attachment to and electrical contact with terminal plug 36.

Referring simultaneously to all figures, installation of the instant inventive light fixture 1 into an exemplary gypsum board ceiling commences prior to installation of the gypsum board panel beneath the ceiling's trusses or joists. "T" braces fitted to span between a desired gap between trusses or joists are engaged with opposing "T" brace receiving clips 10. The distal ends of such braces are then nailed into the side walls of the ceiling trusses or joists. Preferably, such fixture mounting positions the undersurface of mounting plate 6 flush with the lower surfaces of the trusses or joists. The flush positioning of mounting plate 6 allows the cylindrical ceiling aperture lining flange 44 to extend into and serve as a lining sleeve of an aperture within a gypsum board panel to be later installed. At any point after mounting of the fixture as described, the gypsum board may be installed.

Upon such secure mounting of the fixture, electrical conduit 18 and power cord 16 are extended through the building's attic space to junction box 12, said wires 16 being further extended through lined aperture 36. Thereafter, ballast 50 is fixedly and removably attached to wall 4 of shroud 2 by means of spirally threaded screws 20. Thereafter, input power cord 16 is electrically connected to input terminals (not depicted) of ballast 50. Where the ballast has no power input terminals, insulated slip joint terminals (not depicted) in line with line 16 are preferably provided. Upon installation of the ballast 50, air dam 26 is then extended through a trim ring 26, allowing trim ring 26 to rest upon the upper surface of out-turned flange 27.

The output power cords 52 of ballast 50 are then extended through an aperture within the side wall of air dam 26, and rubber air sealing channeled ring 40 along with a slotted rubber sleeve 48 are positioned as depicted in FIG. 3, causing said ring and sleeve 40 and 48 to effectively fill the annulus between output power cords 52 and air dam 26. The upper end of air dam 26 is then extended upwardly through the air dam receiving space of flange 44 causing friction clips 42 to engage the exterior side walls of air dam 26, holding air dam 26 in place, and allowing out-turned flange 27 of air dam 26 to hold trim ring 28 in place. Thereafter, terminal plug 36 is plugged into plug housing 30. Finally, the preferred circline flourescent light tube 22 is manually moved upwardly into the interior space of air dam 26 until spring clips 24 engage and hold tube 22 in place.

Disassembly for purposes of gypsum board installation or for change out of components may be effectuated by reversing steps set forth above.

In operation, the instant inventive flourescent light fixture provides for convenient ballast and flourescent light tube interchangeability while preserving thermal barrier characteristics of the gypsum board panel into which said fixture is mounted.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A lamp for recessed ceiling mounting, the ceiling having flange receiving aperture, the lamp comprising:

(a) a cylindrical ceiling aperture lining flange, said flange having an upper end and a lower end, said flange defining an air dam receiving space;

(b) ceiling mounting means fixedly attached to the upper end of the cylindrical ceiling aperture lining flange;

(c) a flourescent light tube actuating ballast;

(d) ballast mounting means removably mounting the flourescent light tube actuating ballast upon the upper end of the cylindrical ceiling aperture lining flange;

(e) a concave air dam having an inner surface defining a flourescent light tube receiving space;

(f) air dam mounting means removably mounting the concave air dam within the air dam receiving space of the cylindrical ceiling aperture lining flange;

(g) a flourescent light tube;

(h) tube mounting means removably mounting the flourescent light tube upon the inner surface of the concave air dam, said means positioning said tube within said air dam's flourescent light tube receiving space; and, (i) a network of electrically conductive wires interconnecting the flourescent light tube actuating ballast and the flourescent light tube.

2. The lamp of claim 1 wherein the ceiling mounting means and the ballast mounting means comprise a frame having an air dam receiving aperture, wherein the air dam receiving space of the cylindrical ceiling aperture lining flange underlies said aperture, and wherein the frame spans between the flourescent light tube actuating ballast and the upper end of said flange.

3. The lamp of claim 2 wherein the frame comprises a mounting plate.

4. The lamp of claim 3 wherein the cylindrical ceiling aperture lining flange is circular, wherein the concave air dam has a circular horizontal cross-sectional shape, wherein the air dam receiving aperture is circular, and wherein the flourescent light tube is circline.

5. The lamp of claim 4 wherein the concave air dam has a side wall, having a wire receiving aperture, and wherein the network of electrically conductive wires extends through said aperture.

6. The lamp of claim 5 wherein the interior surface of the concave air dam is reflective.

7. The lamp of claim 6 wherein the wire receiving aperture of the concave air dam in combination with the extension therethrough of the network of electrically conductive wires defines an annulus, and further comprising an annular air seal spanning said annulus.

8. The lamp of claim 6 wherein the tube mounting means comprises a plurality of spring clips.

9. The lamp of claim 6 wherein the ballast mounting means comprises a plurality of spirally threaded screws.

10. The lamp of claim 6 wherein the air dam mounting means comprises a plurality of friction clips.

11. The lamp of claim 1 wherein the ceiling mounting means comprises a frame extending outwardly from the upper end of the cylindrical ceiling aperture lining flange, and further comprising a shroud having a side wall, the shroud being fixedly attached to the frame, the shroud overlying the flourescent light tube actuating ballast, overlying the concave air dam, and overlying said flange.

12. The lamp of claim 11 wherein the ballast mounting means comprises the side wall of the shroud and the frame, said side wall and frame in sequence mechanically linking the flourescent light tube actuating ballast and the upper end of the cylindrical ceiling aperture lining flange.

13. The lamp of claim 12 wherein the frame comprises a mounting plate.

14. The lamp of claim 13 wherein the cylindrical ceiling aperture lining flange is circular, wherein the concave air dam has a circular horizontal cross-sectional shape, wherein the air dam receiving aperture is circular, and wherein the flourescent light tube is circline.

15. The lamp of claim 14 wherein the concave air dam has a side wall, having a wire receiving aperture, and wherein the network of electrically conductive wires extends through said aperture.

16. The lamp of claim 15 wherein the interior surface of the concave air dam is reflective.

17. The lamp of claim 16 wherein the wire receiving aperture of the concave air dam in combination with the extension therethrough of the network of electrically conductive wires defines an annulus, and further comprising an annular air seal spanning said annulus.

18. The lamp of claim 16 wherein the tube mounting means comprises a plurality of spring clips.

19. The lamp of claim 16 wherein the ballast mounting means comprises a plurality of spirally threaded screws.

20. The lamp of claim 16 wherein the air dam mounting means comprises a plurality of friction clips.

* * * * *